US005900155A

United States Patent [19]

Bedi

[11] Patent Number: 5,900,155

[45] Date of Patent: May 4, 1999

[54] METHOD AND APPARATUS FOR RECONDITIONING OIL OF VEHICLES

[75] Inventor: Ram D. Bedi, Bloomfield Hills, Mich.

[73] Assignee: K.J. Manufacturing Co., Wixom, Mich.

[21] Appl. No.: 08/865,547

[22] Filed: May 29, 1997

[51] Int. Cl.[6] ..... B01D 17/12; C10M 175/00; F01M 1/10

[52] U.S. Cl. ..... 210/739; 123/196 A; 184/1.5; 184/6.24; 184/108; 196/46.1; 208/179; 208/DIG. 1; 210/91; 210/96.1; 210/171; 210/805; 210/198.1

[58] Field of Search ..... 210/86, 87, 91, 210/96.1, 101, 134, 143, 168, 171, 241, 243, 257.1, 259, 416.5, 739, 787, 805, 806, 90, 109, 167, 198.1, 799; 184/1.5, 6.21, 6.24, 108; 123/196 A, 196 R; 196/46, 46.1; 208/179, 180

[56] References Cited

U.S. PATENT DOCUMENTS

| | | | |
|---|---|---|---|
| 1,337,408 | 4/1920 | Morris | 184/1.5 |
| 1,553,141 | 9/1925 | Clark | 184/1.5 |
| 2,174,265 | 9/1939 | Holt | 196/46.1 |
| 2,268,706 | 1/1942 | Holt | 196/46.1 |
| 3,489,245 | 1/1970 | Broadwell | 184/1.5 |
| 4,128,140 | 12/1978 | Riches | 184/1.5 |
| 4,179,019 | 12/1979 | Danziger | 196/46.1 |
| 4,943,352 | 7/1990 | Lefebvre et al. | 196/46.1 |
| 5,044,334 | 9/1991 | Bedi | 123/196 R |
| 5,062,500 | 11/1991 | Miller et al. | 184/1.5 |
| 5,263,445 | 11/1993 | Bedi et al. | 123/196.005 |
| 5,330,636 | 7/1994 | Reichert | 210/96.1 |
| 5,452,695 | 9/1995 | Bedi | 123/196 A |
| 5,676,842 | 10/1997 | Bedi et al. | 184/108 |

FOREIGN PATENT DOCUMENTS

96/23854 8/1996 WIPO .

OTHER PUBLICATIONS

TF Purifiner Hydraulic Batch System #120–12, TF Purifiner, Inc., Feb. 16, 1996.

Analytic Systems Laboratories Finite Particle Removal Systems, 7 pgs.

*Primary Examiner*—Joseph W. Drodge

*Attorney, Agent, or Firm*—Young & Basile, P.C.

[57] ABSTRACT

An apparatus for on-site engine oil reconditioning comprises an apparatus configured and arranged for changing oil by removing spent oil from, and introducing reconditioned oil into an internal combustion engine. A mechanism, in fluid communication with the oil changing apparatus, removes finite particles from the spent oil to produce particle-free oil. A mechanism, in fluid communication with the finite particle removing mechanism, refines the particle-free oil to remove water, fuel, and/or glycols to produce re-refined oil. A mechanism, in fluid communication with the refining mechanism, adjusts the composition of the re-refined oil to meet a predetermined specification to produce the reconditioned oil. A process for reconditioning oil on-site at a user's facility comprises the steps of: removing spent oil from the internal combustion engine; removing finite particles from the spent oil to produce particle-free oil; refining the particle-free oil to remove water, fuel, and/or glycols to produce re-refined oil; adjusting the composition of the re-refined oil to meet a predetermined specification to produce reconditioned oil; optionally storing the reconditioned oil until needed; and introducing the reconditioned oil into the internal combustion engine.

20 Claims, 4 Drawing Sheets

METHOD AND APPARATUS FOR RECONDITIONING OIL OF VEHICLES

BACKGROUND OF THE INVENTION

This invention relates generally to a method and apparatus for recycling and reconditioning oil, and more specifically to such a method and apparatus for convenient use on-site at the user's facility.

It is common knowledge that oil must be changed regularly in internal combustion engines in order to enhance engine performance and to prevent any deleterious side effects. In the trucking industry, such as for example the class 8 trucking industry, some trucks log up to about 300,000 miles per year. One truck engine manufacturer recommends that the oil be changed every 60,000 miles when using synthetic oil, which translates into about 5 oil changes per year. An average truck uses about 10 gallons of new oil per oil change at a cost of approximately $15.00 per gallon. This translates into $150.00 per oil change, or $750.00 per truck per year. For a high mileage truck fleet owner having perhaps 100 trucks, one can readily ascertain that the yearly cost of oil changes, ie., $75,000.00, can be quite substantial. Moderate mileage trucks log about 120,000 miles per year and change engine oil about every 25,000 miles when using an appropriate petroleum base engine oil, for example 15W40 specification.

In addition, due to environmental concerns, EPA regulations and the like, the user, such as a truck fleet servicing facility, must dispose of the oil in an environmentally safe manner. As seen in FIG. 1, this disposal may proceed as follows. First, the spent oil is drained from the vehicle 100. The spent oil is then collected in an on-site oil collection area 102 located at the user's facility. The oil is then picked up and taken to an off-site oil collection facility 104. From this facility 104, some of the oil is sold and is burned for heat 106, while the remainder is sent to, or picked up by a bulk oil handler 108. The bulk oil handler then takes the spent oil to a re-refiner 110 who must remove all finite particles from the spent oil, and re-refine it to remove any moisture, diesel fuel and/or glycols which may be present. The re-refined oil is then sent to a formulator 112 who must check the re-refined oil composition to ascertain whether such characteristics as viscosity, lubricity, pH and the like are within a desired specification. If they are not, formulator 112 must make any adjustments to the re-refined oil composition to bring it within the desired specifications. The re-refined and adjusted oil is then sent to a distributor 114. If the user wishes to utilize reconditioned oil, the user then buys that reconditioned oil from distributor 114.

As can be seen from FIG. 1, this method of recycling is labor intensive, very time consuming and expensive. Thus, the user is caught in a dilemma between the great expense incurred by utilizing all new oil at every oil change and the expense and trouble involved with utilizing recycled or reconditioned oil, some of which time and expense the user cannot escape (due to environmental regulations) even if he were to choose to use new oil at every oil change.

Thus, it is an object of the present invention to provide an apparatus and process for reconditioning oil on-site at the user's facility, thereby advantageously allowing the user to save the time and expense of collecting and sending spent oil to an off-site collection and/or recycling facility. It is a further object of the present invention to provide such an apparatus which is portable and advantageously does not require an inordinate amount of floor space in the user's facility. Yet further, it is an object of the present invention to provide an oil changing apparatus for use in the on-site reconditioning apparatus, which oil changing apparatus quickly and efficiently removes spent oil substantially completely and easily from the crank case.

SUMMARY OF THE INVENTION

The present invention addresses and solves the above-mentioned problems and achieves the above-mentioned objects and advantages by providing an apparatus for on-site oil reconditioning, comprising an apparatus configured and arranged for changing oil by removing spent oil from, and introducing reconditioned oil into an internal combustion engine having an engine block and an internal oil lubrication system, an oil filter and an oil reservoir. Means, in fluid communication with the oil changing means, are provided for removing finite particles from the spent oil to produce substantially particle-free oil. The reconditioning apparatus further comprises means, in fluid communication with the finite particle removing means, for refining the substantially particle-free oil to remove at least one of water, fuel, and glycols to produce substantially re-refined oil. Further, means, in fluid communication with the refining means, are provided for adjusting the composition of the substantially re-refined oil to meet a predetermined specification to produce the reconditioned oil.

A process for reconditioning oil on-site at a user's facility according to the present invention comprises the steps of: removing spent oil from the internal combustion engine; removing finite particles from the spent oil to produce substantially particle-free oil; refining the substantially particle-free oil to remove at least one of water, fuel, and glycols to produce substantially re-refined oil; adjusting the composition of the substantially re-refined oil to meet a predetermined specification to produce reconditioned oil; storing the oil on-site until needed; and introducing the reconditioned oil into the internal combustion engine.

BRIEF DESCRIPTION OF THE DRAWINGS

Other objects, features, advantages and applications of the present invention will become apparent by reference to the following detailed description and to the drawings, in which.

DETAILED DESCRIPTION OF THE PREFERRED EMBODIMENTS

Figure 1:
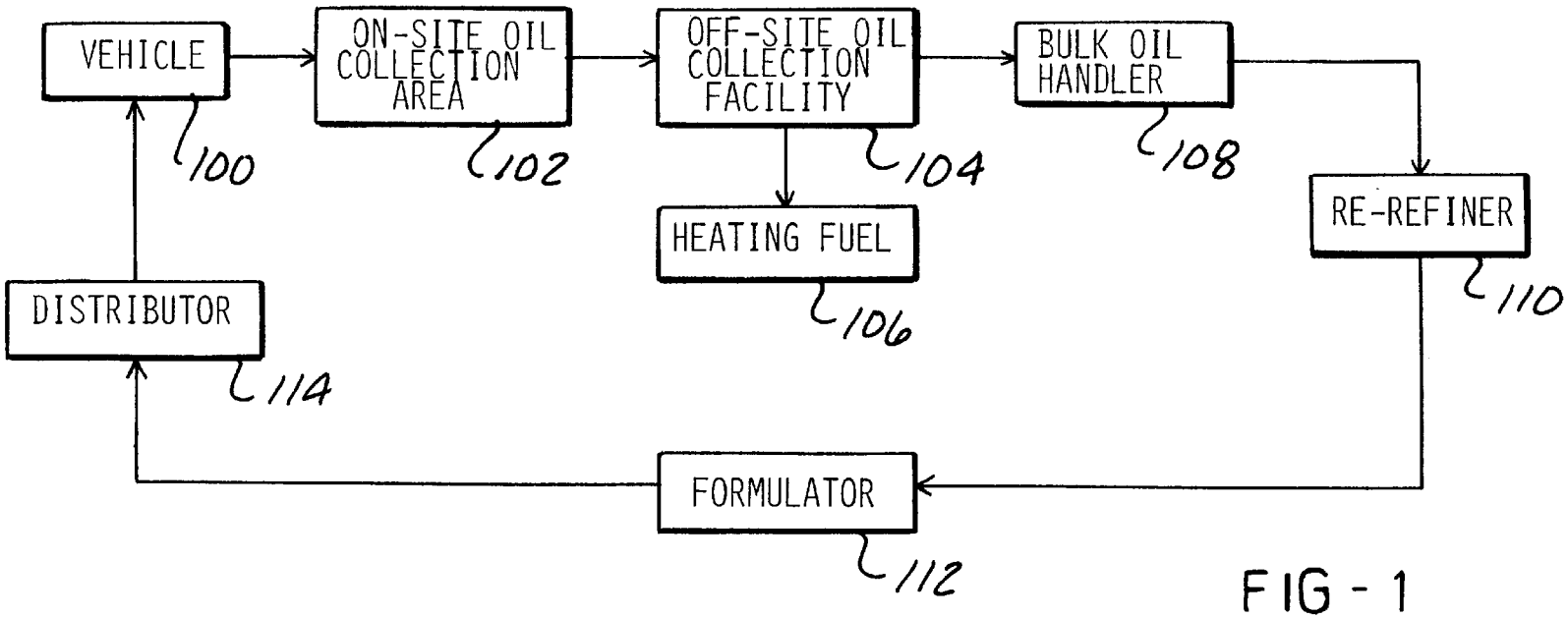
FIG-1 PRIOR ART
FIG. 1 is a flow diagram of a prior art process for off-site reconditioning of oil and distribution thereof.
Figure 2:
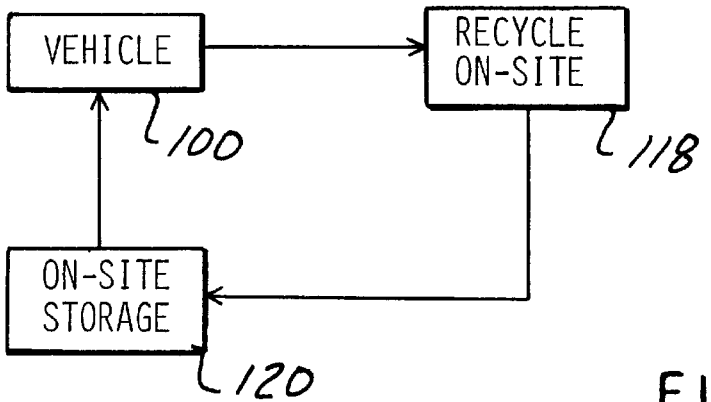
FIG. 2 is a simplified flow diagram of the on-site reconditioning process according to the present invention.

Referring now to FIG. 2, a flow diagram according to the apparatus and process of the present invention reflects that the spent oil goes from the vehicle 100 to the oil reconditioning apparatus 116 (see FIG. 3) whereby it is recycled on-site (step 118). It is then sent to an on-site reconditioned oil storage means 120, from which storage means 120 it may be reintroduced into vehicle 100 as needed.

Figure 3:
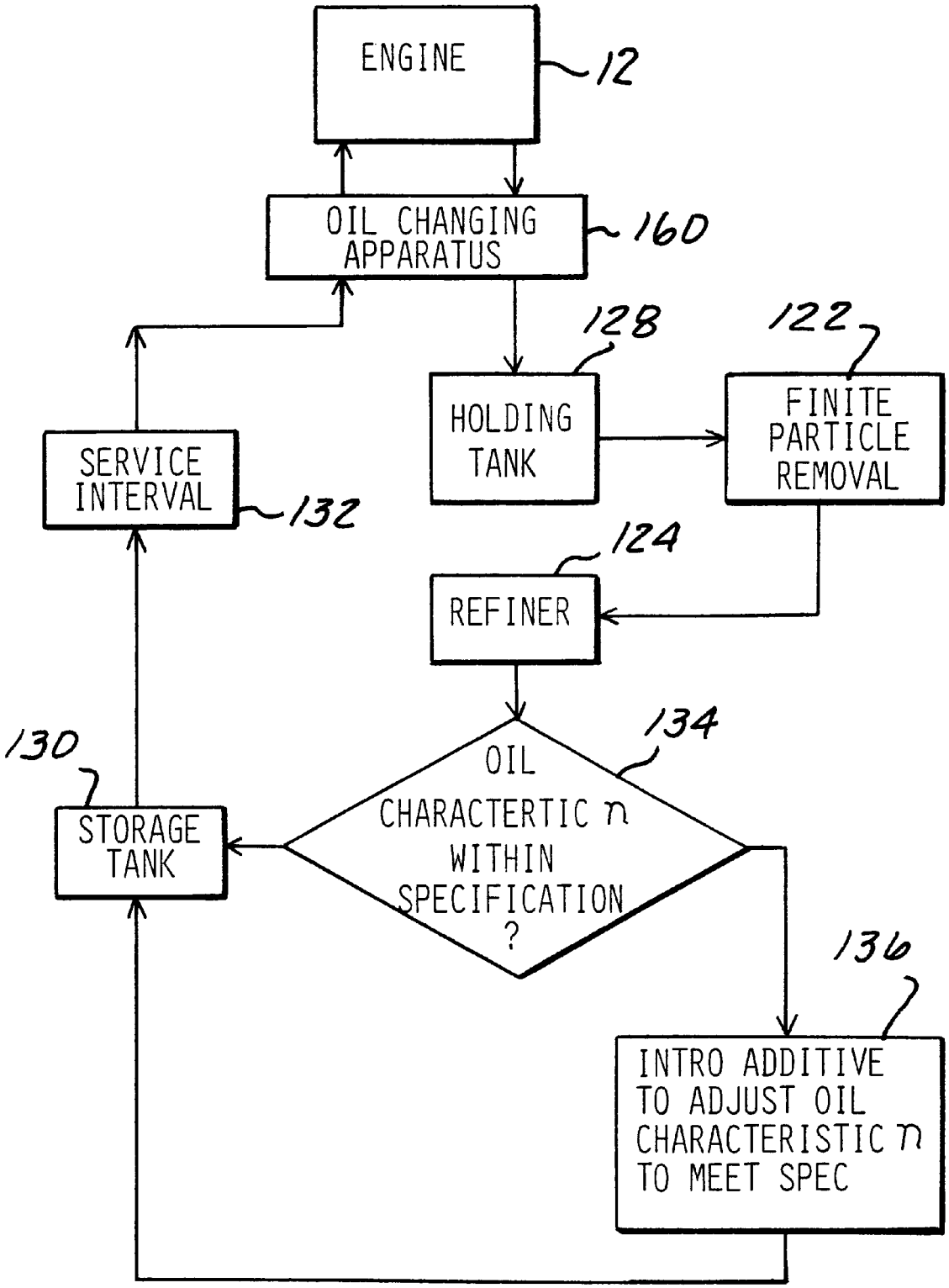
FIG. 3 is detailed flow diagram of the on-site recycle and storage steps of FIG. 2.

The recycle on-site step 118 is shown in more detail in FIG. 3. The apparatus 116 for on-site oil reconditioning comprises an oil changing apparatus 160 configured and arranged for changing oil by removing spent oil from, and introducing reconditioned oil into an internal combustion engine 12 having an engine block 13 and an internal oil lubrication system 46, an oil filter 34 and an oil reservoir 26, the oil filter 34 having an inlet side 35 and an outlet side (see as two examples, FIGS. 5 and 6).

The oil reconditioning apparatus 116 further comprises means 122, in fluid communication with the oil changing apparatus 10, for removing finite particles from the spent oil to produce substantially particle-free oil. These finite particles are a result of repeated prolonged use. During this use, motor oil builds up suspended particles, metallic and non-metallic, from the abrasive and adhesive wear of engine parts against one another and from products of incomplete combustion and improper air intake. The particles in turn cause abrasive wear of the engine bearings, piston rings and other moving parts and the reduction of the motor oil lubricity as various additives and lubricating components become depleted. It is to be understood that this finite particle removing means may comprise any suitable means. Some non-limitative, exemplary particle removing means include a centrifuge, a media filtration device, or electrostatic precipitation.

In the preferred embodiment, the finite particle removing means 122 comprises an electrostatic precipitation device. One such device, suitable for use in the present invention is commercially available from Analytic Systems Laboratories, Inc. (ASL) from Merrillville, Ind. as model number FPRS40 ABH, which is a mobile system. ASL's mobile systems can be moved from location to location, where they can be connected directly to equipment oil reservoirs. ASL's bolt-on systems mount on the side of equipment, and continuously circulate in and out of the reservoir. Whether the mobile or the permanently attached unit is used, the ASL systems are designed for unattended operation, and can be left in place until desired oil purity is reached.

The ASL Finite Particle Removal System first passes contaminated fluid through a water elimination system (not shown) where free and emulsified water is removed to 25 ppm or less. Then the dried oil passes through the electrostatic cell's electrically charged plates and magnetic fields for the final stage of particulate removal.

This final stage removes submicronic particles, and materials that cause tars and varnishes. The FPRS40 ABH Finite Particle Removal System removes the submicronic particles from non-flammable oils by electrostatic and electromagnetic principles. This is accomplished by electronically influencing the particles in the oil to an opposite polarity. The influenced particles are attracted to one another and are retained in the system's electrostatic cell (not shown) until intentionally backflushed by the operator. The cell has alternating electrostatic and magnetic fields. If, for example, a particle is negative, it will seek the positive side of a magnetic plate. When the particles begin to collect together—one on top of the other, alternating as positive and negative particles—the polyolefin foam filler (not shown) inside the cell becomes a home for the particles and holds them in place. This collection of particles is a phenomenon known as "strawing."

Any particle, regardless of size, can be electronically influenced and removed from oil. It is believed that contaminated oil that is processed by the electrostatic precipitation device as used in the present invention is made cleaner than has previously been possible.

Some technical data for the ASL FPRS40 ABH Finite Particle Removal System is as follows: Typical fluids: Bases include both hydrocarbon and synthetic; types include hydraulic, transmission, insulating, compressor, transformer, turbine.

The FPRS40 ABH Finite Particle Removal System has one electrostatic cell and a water absorber. Other components (not shown) include a pump, motor and supporting solid-state electronics. The system may be mounted on a 2-wheel cart for portable operation if desired. The unit filters non-flammable oils, and is designed for continuous operation. One such portable unit, the FPRS40 ABH, has the following dimensions: Width: 21", Height: 49", Depth: 22.5", and Weight: 300 lbs. The pump is a spur gear pump with a flow rate of 40 gallon/hour with 100 SSU fluid.

The FPRS 40 ABH can purify batches of up to 800 gallons. The electrostatic cell provides non-size-discriminant particle removal. The cell holds 1–1.5 pounds of particles before backflushing is required. Oil cleanliness levels ≦ISO 10/7 are easily maintained at typical ingression levels. The FPRS 40 ABH includes 1 water absorber element; wood and cotton fibers. It absorbs 5–6 quarts of water, and removes 200–300 ppm of free and emulsified water per pass until <100 ppm, with multi-pass removal down to 50 ppm. The system may be used to remove water only, as well as water and particles.

Other FPRS 40 ABH System specifications include an operating pressure of <40 psi; and fluid retention volume is approximately 3 gallons. Other mobile systems, eg., model numbers FPRS200 ABH, FPRS600 ABH may purify batches of between about 4000 and 20000 gallons, or more.

It is to be understood that 100% recovery of oil is generally not possible during the recycling process. Usually about 20% of the oil is lost during the process.

Oil reconditioning apparatus 116 further comprises means 124, in fluid communication with the finite particle removing means 122, for refining the substantially particle-free oil to remove at least one of: moisture (such as water), fuel, and/or glycols to produce substantially re-refined oil. It is to be understood that this refining means 124 may comprise any suitable means, continuous or non-continuous. However, in the preferred embodiment, the refining means comprises a batch system refining device. One such refiner suitable for use in the present invention is commercially available from TF Purifiner, Inc. in Boynton Beach, Fla. as model Hydraulic Batch System #120-12 (although, in the present invention the #120-12 is not used for hydraulic fluids, but rather for engine oil, and in the preferred embodiment, synthetic engine oil).

The #120-12 includes (not shown) a "O" reset hour meter; a cumulative hour meter; two TF-60P Units; an electric heater, one in each lid of the TF-60P Unit; a power switch; a return hose; an oil preheater; a portable aluminum cart with wheels, if desired; an oil pressure gauge; an electric pump; a full flow oil filter; a drain valve; a pressure regulator; a drip pan; a supply hose; and an oil pick up.

The Batch System #120-12 is a mobile unit, if desired, designed to recycle many used hydraulic oils either within a 55 gallon drum or a hydraulic system reservoir, although as stated above, in the present invention it is used to recycle engine oil. The System will remove solid contamination and liquid contamination, such as water, glycols and diesel fuel. In the preferred embodiment, the refining means 124 refines the substantially particle-free oil at a rate of about 6 gallons per hour. However, it is to be understood that the rate may be adjusted as desired for a particular application; and such desired rates are to be considered within the scope of the present invention.

Oil reconditioning apparatus 116 further comprises means, in fluid communication with the refining means 124, for adjusting the composition of the substantially re-refined oil to meet a predetermined specification to produce the reconditioned oil. There are a number of characteristics of oil which are important to monitor to ensure that the oil will function properly. Examples of these are viscosity, lubricity and pH.

More specifically, crank case oils are generally heavily fortified with additives and may contain some or all of the following: detergent-dispersants, oxidation inhibitors, corrosion inhibitors, pour depressants, viscosity-index improvers, anti-wear additives, defoamants, and friction modifiers. Diesel engines, depending on engine manufacturer and ambient temperatures, often use viscosities corresponding to SAE 30 or 40 grades or SAE 15W/40. An example of one ASTM grade of diesel fuel, grade 1-D, is found in ASTM D975. See the Table below.

TABLE

| TEST | ASTM METHOD | ASTM GRADE 1-D OF DIESEL FUEL |
|---|---|---|
| flash point, min, ° F. | D93 | 100 or legal |
| water and sediment, vol %, max | D1796 | trace |
| viscosity, kinematic, centistokes, 100° F. | D445 | |
| min. | | 1.3 |
| max. | | 2.4 |
| carbon residue on 10% residuum, % max. | D524 | 0.15 |
| ash, weight %, max. | D482 | 0.01 |
| sulfur, weight %, max. | D129 | 0.50 |
| ignition quality, cetane number, min. | D613 | 40 |
| distillation, temp, ° F., 90% evaporated, max | D86 | 550 |

From the above, it can be seen that crank case oil, including reconditioned oil, includes a plurality of desired components (which may or may not have been enumerated in the exemplary listing above), each of the plurality of components having an associated predetermined specification.

It is to be understood that the oil composition adjusting means may comprise any suitable means; however, in the preferred embodiment, this oil adjusting means comprises means 134 for analyzing the re-refined oil to determine the presence and amount of at least one of the plurality of desired components, generally designated "n" in step 134. An example of some components to be analyzed includes viscosity-index improvers, lubricants, and buffering materials. The oil adjusting means may further comprise means 136, in fluid communication with the analyzing means 134, for introducing at least one additive to adjust a corresponding component "n" to be within the associated predetermined specification. It is to be understood that these analyzing 134 and introducing 136 means may comprise any suitable and conventionally known means. The introducing means may be in fluid communication with a reconditioned oil storage tank, whereby the adjusted, now reconditioned oil may be directly sent to storage to await introduction into the vehicle.

The adjusting means may further optionally comprise means for checking the adjusted oil to verify that the additive introduction brought the desired component within the associated predetermined specification.

Although the present apparatus and process may be suitable for many types of petroleum products, it is particularly advantageous in the area of synthetic oils. One non-limitative example of a suitable synthetic engine oil is commercially available under the tradename MOBILE 1.

A further advantage of the present invention is that the oil reconditioning apparatus 116 may be portable and can easily be incorporated into an existing facility such as a truck fleet owner's service facility.

A process according to the present invention for reconditioning oil on-site at a user's facility comprises the steps of: removing spent oil from an internal combustion engine 12 having an internal oil lubrication system 46, an oil filter 34 and an oil reservoir 26, the oil filter 34 having an inlet side 35 and an outlet side. This step can be seen at directional arrow 126 in FIG. 3. Removing step 126 is accomplished via oil changing apparatus 160. It is to be understood that oil changing apparatus 160 may comprise any suitable oil removing method and/or apparatus, for example any conventionally known method such as gravity sump draining and/or pump assisted draining; or it may comprise the oil exchange apparatus 10 described in further detail below.

It is to be further understood that the oil changing apparatus 160 may include both a means for carrying out the removing step 126 and a means for carrying out the fresh oil introducing step, as shown at directional arrow 156; or the oil changing apparatus 160 may comprise two separate means, one for each function. It is to be understood that, as used herein, "fresh oil" means any oil which is not spent and is ready to be introduced into engine 12; "fresh oil" may include: 100% new (virgin) oil; 100% reconditioned oil; 80% reconditioned oil and 20% new oil; or any suitable combination of new and reconditioned oil, as desired. It is to be understood that oil changing apparatus 160 may further comprise any suitable fresh oil introducing method and/or apparatus, for example any conventionally known method such as manual introduction and/or pump assisted introduction; or it may comprise the oil exchange apparatus 10 described in further detail below.

After the spent oil is removed, it is routed to a holding tank 128. From there it is sent to the finite particle remover 122, and to the refiner 124. At that time it is run through one or more analytical tests to determine various characteristics such as viscosity, lubricity, and pH, as well as the presence and/or amount of any or all of the above additives mentioned above.

If the composition of the re-refined oil is within the desired specification(s), it is sent to storage tank 130. The vehicle then goes through service interval 132 of, for example, 60,000 miles. After the spent oil is removed via oil changing apparatus 160, the reconditioned oil may be taken from storage tank 130 and introduced, via oil changing apparatus 160, into the vehicle 100 as desired.

In using the reconditioned oil, about one or two gallons of new (virgin) oil may be introduced with an amount of reconditioned oil sufficient to bring the engine oil to the desired level. The reconditioned oil/new oil mix may be used generally for every other oil change. Thus, a truck would generally have three new oil changes and two reconditioned oil changes, or vice versa, for a total of five oil changes per year. One of the many advantages of the present invention is related to cost effectiveness—it is estimated that the cost of a gallon of reconditioned oil produced by the apparatus and process of the present invention would be significantly less than the cost of a gallon of new oil. This could advantageously translate into a cost savings per year, for a fleet of 100 high mileage trucks, of approximately $30,000.

It is to be understood that, if oil changing apparatus 160 comprises the oil exchange apparatus 10, this apparatus 10 may comprise many suitable apparatuses.

Some examples of suitable apparatuses may be found in Applicant's U.S. Pat. Nos. 4,884,660; 5,209,198; 5,044,334; 5,062,398; 5,263,445; 4,951,784; 4,976,233; 5,074,380; 5,154,775; 5,090,376; 5,094,201; 5,122,020; 5,145,033; 5,411,114; 5,295,521; 5,385,178; 5,297,595; 5,327,862; 5,452,695; 5,443,138; 5,454,355; 5,526,782 and 5,588,502.

Figure 4:
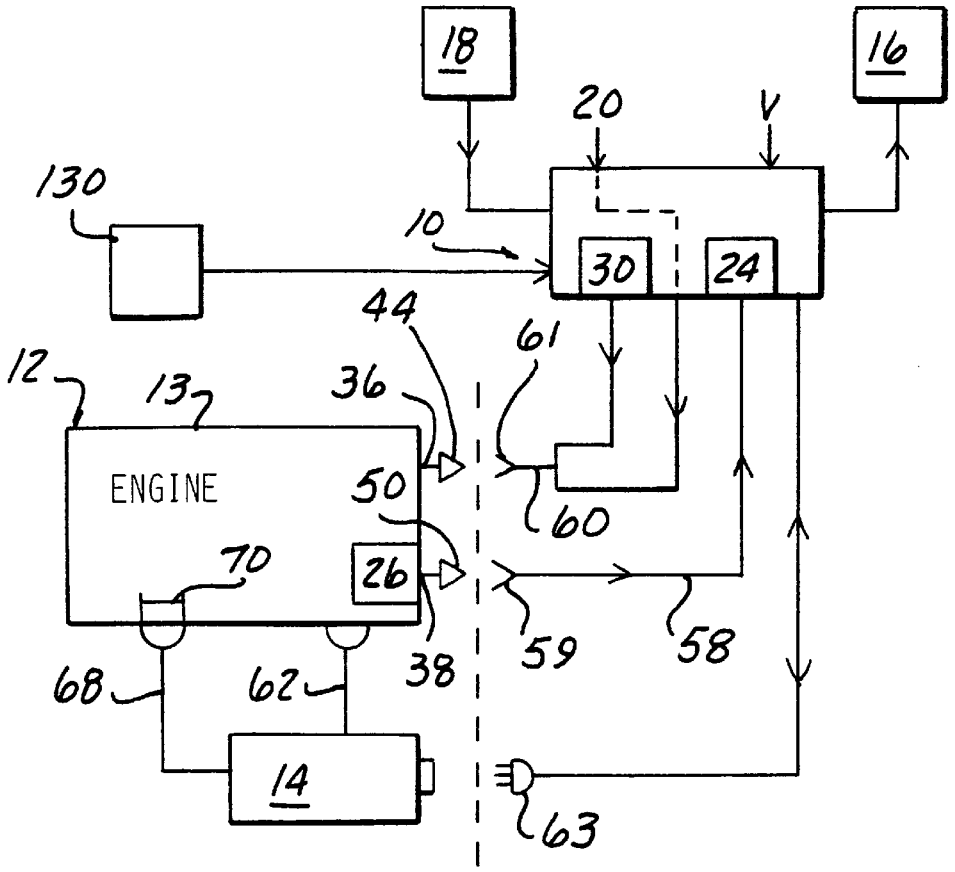
FIG. 4 is a schematic view of an oil change apparatus connected to an associated internal combustion engine according to the present invention.
Figure 6:
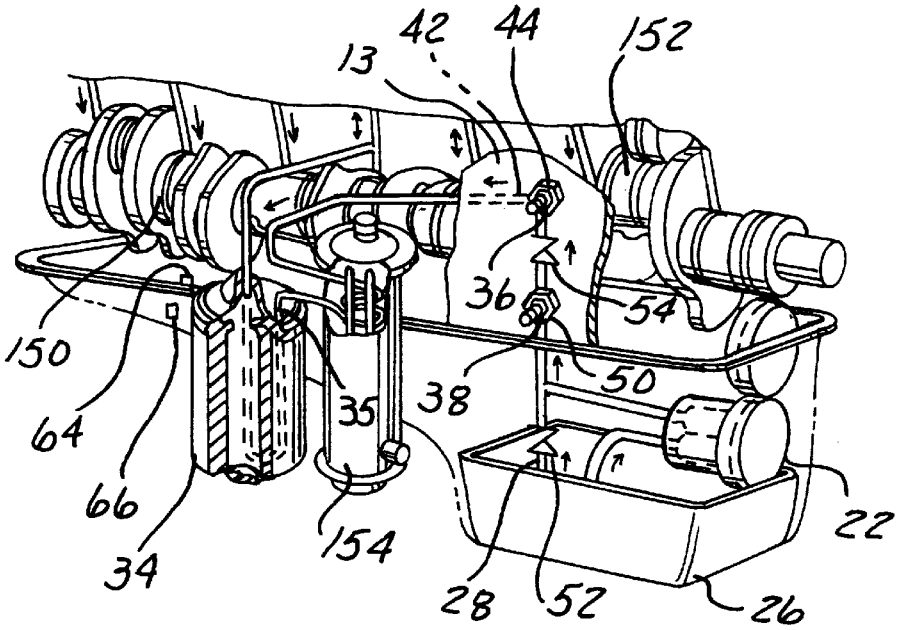
FIG. 6 is a partially schematic perspective view, partially cut away, of an internal combustion engine showing a second embodiment of the internal connections for an external oil changing apparatus according to the present invention.
Figure 5:
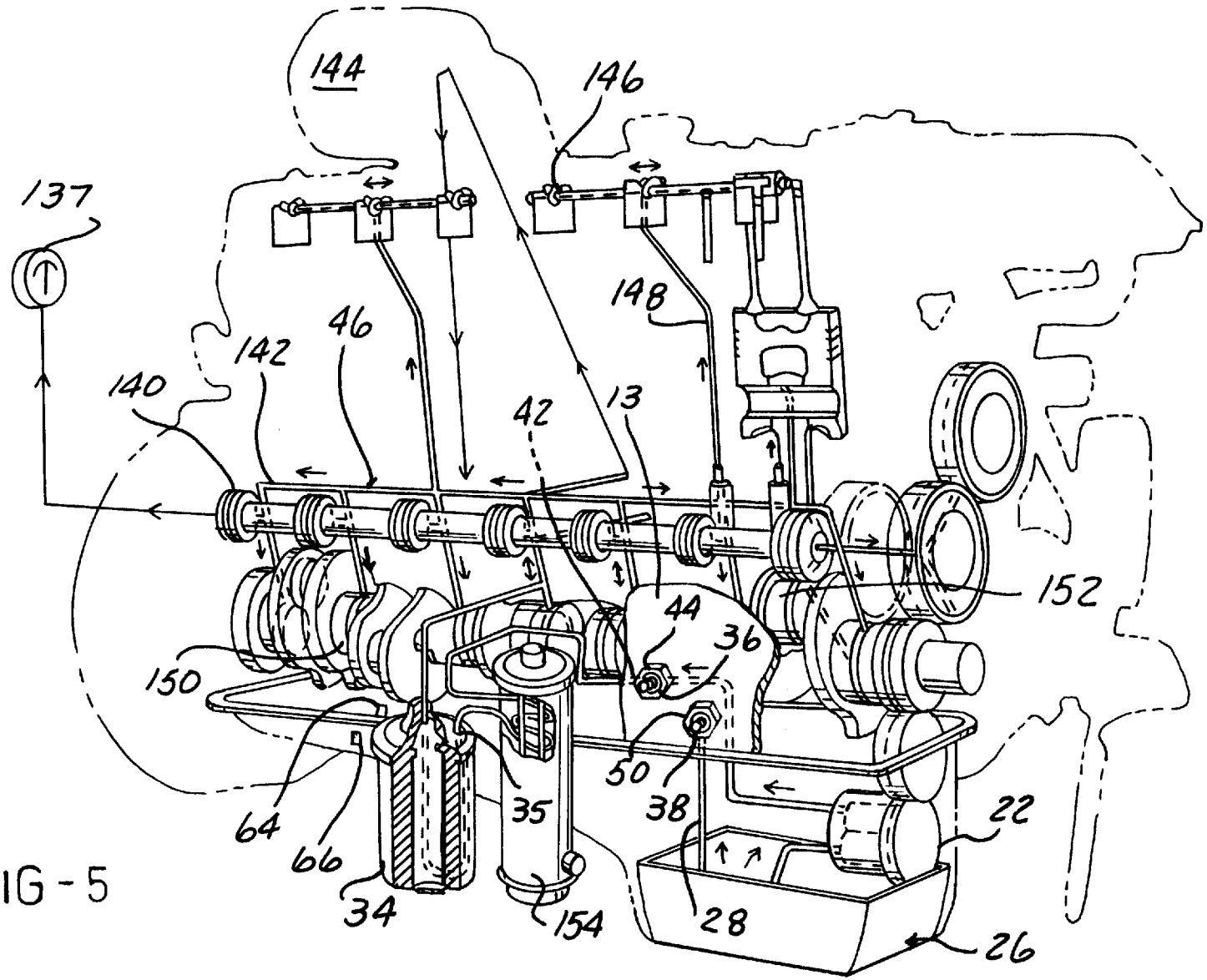
FIG. 5 is a partially schematic perspective view, partially in phantom, of an internal combustion engine showing one embodiment of the internal connections for an external oil changing apparatus according to the present invention.

However, in the preferred embodiment, a suitable process and apparatus is shown in FIGS. 4–5, with the second embodiment thereof shown in FIG. 6. It is to be understood that the present invention may be suitable for use with any type of internal combustion engine 12. However, in the preferred embodiment, the present invention 116 is adapted for use with a diesel engine. An illustrative diesel engine is shown in FIGS. 5 and 6. The diesel engine includes oil pressure gauge 138, camshaft bearings 140, oil gallery 142, turbo compressor 144, rocker arm mechanism 146, passage 148 for oil to rocker arm mechanism, crankshaft bearings 150, connecting rod bearing 152, and optional oil cooler 154.

The oil exchange apparatus 10 of the present invention is depicted schematically in FIG. 4, which schematic diagram is useful for the embodiments shown in FIGS. 5–6.

With reference to FIG. 4, the present invention includes an oil changing apparatus, generally designated as 10, which is separable from an internal combustion engine generally designated as 12. The internal combustion engine 12 has an on-board electronic module 14 having sensors and a memory chip for storing relevant information for facilitating the oil change process. Such sensors may include an oil pressure signal, and a signal indicating that an oil filter is in place. The memory chip, which may or may not be in electrical contact with electronic module 14, may store various vehicle information including a vehicle I.D., engine oil capacity, and an oil change history. It is understood that the memory chip of the electronic module 14 may store all or some of the above listed items as well as other items as desired. When the oil exchange apparatus 10 is fluidly connected to the lubrication system in the internal combustion engine, an electrical connection is also provided to the vehicle electronic module 14 for reading and updating the aforementioned vehicle information.

The oil exchange apparatus 10 of the present invention is connectable to external storage means. Storage means may include a waste oil storage receptacle 16 and a new motor oil supply receptacle 18. The oil exchange apparatus 10 also includes a connection to a source of compressed air 20, such as a compressor. Of course, it is recognized that the pressure by which the compressed air 20 is supplied to the oil exchange apparatus 10 must be controlled so that excessive pressure is not delivered to the internal oil lubrication distribution passage system. This pressure should be no more than the pressure of the oil pump 22, shown in FIGS. 5 and 6, of the internal combustion engine. It should be recognized that the appropriate control means for regulating pressure is also provided. The source of compressed air 20 is well known to those skilled in the art of compressed air delivery systems and is commercially available. It should also be noted that the compressed air 20 delivered to the internal oil lubrication distribution passage system should be clean and dry so that minimal or no particles and/or water is introduced into the internal oil lubrication distribution passage system which could thereby cause problems such as rust of lubrication distribution passage system components, as well as degradation of the oil to be introduced thereinto.

As depicted schematically in FIGS. 4 and 5, the pump means may include a first pump 24 for drawing spent oil from the oil reservoir 26 through the drain line 28 of the internal combustion engine for discharge into the waste oil storage means. Pump means may also include a means 30 for introducing fresh motor oil from at least one of the new (virgin) motor oil storage receptacle 18 or the reconditioned oil storage tank 130 into the internal oil lubrication distribution passage system of the internal combustion engine 12.

Modifications to the engine block 13 are shown according to the present invention in FIGS. 5–6. Two ports are placed in the engine block, by casting or other appropriate means. One of the ports 36 is for fluid communication to the inlet (unfiltered) side of the oil filter 34, and the other port 38 is in fluid communication with the bottom of the oil reservoir/pan 26 via internal cast passages and oil drain suction tube. These two ports 36, 38 may be used to install quick connect fittings, and are located so as to easily make connections to the external oil exchange apparatus 10 via mating quick connect couplers.

FIG. 5 shows one embodiment for the internal cast passages for oil communication throughout the internal combustion engine 12. The first port 36, which is located downstream from the oil pump 22 and upstream from the filter inlet side 35 (as shown), opens to a branch passage that connects with a main passage 42 leading from the oil reservoir 26 to the inlet (unfiltered) side 35 of the oil filter. The first port 36 has a quick connect fitting 44 which includes means for preventing flow through the port 36 unless quick connect fitting 44 is connected to a mating external coupling 61, shown in FIG. 4. The connection to quick connect fitting 44 may be used to send in purge air to purge oil out of the oil filter 34 and the oil passages into the oil reservoir 26, thereby removing oil that would not normally drain during a conventional oil process.

The connection 44 may also be used to introduce fresh oil into the engine. The oil introduction procedure fills the oil filter 34 first after which the filtered oil enters the oil passages, as represented at 46, under pressure. As a result, instant oil pressure and lubrication during engine start up is achieved.

Second port 38 opens to passage 28 which is a drain line from the oil reservoir 26 providing fluid communication with the bottom of the oil reservoir 26. The second port 38 has quick connect fitting 50 which includes means for preventing flow through the port 38 unless quick connect fitting 50 is connected to a mating external coupling 59, shown in FIG. 4. Quick connect fitting 50 may be used to remove oil from the oil reservoir 26 by applying suction by the external oil exchange apparatus 10. This procedure may be a separate function or be done in conjunction with the air purge process.

FIG. 6 shows an alternative embodiment similar to the previous embodiment except that the oil drain suction line 28 is directly connected to the oil pump 22 outlet line. A check valve 52 is positioned in the oil drain line 28 prior to its connection to the oil pump outlet line that proceeds to the inlet 35 of the oil filter 34. Check valve 52 prevents oil passing through the screened inlet and oil pump 22 into the oil pump outlet line from flowing back into the oil reservoir via oil drain line 28. A second check valve 54 is disposed in main passage 42 between the branch passage which communicates with the first port 36 and an evacuation branch passage which communicates with second port 38. Second check valve 54 ensures that there is no other flow than from the bottom of the oil reservoir 26 through the oil drain line 28 and check valve 52. Similarly to the embodiment shown in FIG. 5, first 36 and second 38 ports have quick connect fittings 44 and 50, respectively, which include check valves which prevent flow through the ports unless the respective quick connect fittings are connected to corresponding external couplings 61 and 59.

In operation, the internal combustion engine 12 is brought into proximity with the oil changing apparatus 10. The fluid conduit hose 58 from the oil exchange apparatus 10 having a first quick connect coupling 59 is connected to the oil drain connection 50 on the engine block. The oil drain connection 50 is fluidly connected to the oil reservoir 26 of the internal combustion engine 12. Another hose 60 with a second quick connect coupling 61 from the oil exchange apparatus 10 is connected to the filter inlet connection 44 connected to the internal combustion engine for introducing compressed air and fluid into the internal combustion engine 12 through the filter element 34 and finally into the internal oil lubrication distribution passage system 46 of the internal combustion engine for subsequent accumulation in the oil pan reservoir 26. The oil exchange apparatus 10 is connected to an electrical energy outlet V as well as connected to the vehicle electronic module 14 at 63 for access to vehicle information and safety information.

The oil exchange apparatus 10 is activated upon initial start-up by reading information from the vehicle electronic module 14 regarding the vehicle, so that the oil change process is facilitated. Such information could include a vehicle I.D., the capacity of the oil reservoir 26, and a history of previous oil changes. Other pertinent information may also be read as needed. In addition, the oil exchange apparatus also reads various signals for safety reasons. One such signal is the "oil filter securely in place" signal 62. The "oil filter in place" signal 62 tells the oil exchange apparatus 10 whether or not the oil filter 34 is securely in place. If the oil filter 34 is not securely in place, the oil exchange apparatus 10 will not activate the purge air or new oil filling process. The "oil filter securely in place" signal 62 could be generated preferably by a microswitch 64 embedded in the oil filter mounting face of the engine block such that when the oil filter 34 is installed onto the base of the oil filter mounting face, the oil filter 34 would press against the switch 64 which would close contact and thereby provide a signal 62 that the oil filter 34 is securely in place. When the oil filter 34 is removed from the oil mounting face, the switch 64 would open and thereby send a signal 62 that there is no filter connection. This would deactivate the oil exchange apparatus 10 such that no air or oil could be introduced into the internal combustion engine 12. Alternatively, a signal could be generated by a proximity switch 66, installed near the oil filter 34 which would sense the presence or absence of the filter 34 and thereby provide a similar signal to the oil exchanger 10.

An additional safety feature is provided by an oil pressure signal 68. The oil pressure signal 68 notifies the oil exchange apparatus 10 whether or not there is oil pressure present. The presence of oil pressure is an indication that the internal combustion engine 12 is running. Changing oil with the engine 12 running could severely damage the engine. Thus, when the oil pressure signal 68 is activated, the oil exchange apparatus 10 remains deactivated, and the user will be alerted to stop the engine. The oil exchange apparatus 10 will not proceed until the engine is stopped as confirmed by the oil pressure signal 68. The oil pressure signal 68 prevents the oil change process from taking place while the engine is running. The oil pressure signal 68 may be generated by a pressure sensing device 70 installed on the vehicle, or the signal may be taken from an oil pressure sensor already present on the engine. Once the oil exchange apparatus 10 has determined that the oil filter 34 is in place, the engine 12 is not running and has read and recorded the various pertinent information, the oil exchange apparatus 10 may proceed with the oil changing process.

The oil exchange apparatus 10 introduces substantially clean and dry, pressurized air 20 into the system to purge fluid from the oil filter element 34 thereby causing the residual spent oil retained within the oil filter 34 to be discharged through the internal oil lubrication distribution passage system to the oil pan reservoir 26 of the internal combustion engine 12. The air enters through filter inlet connection 44 and passes through passage 42 through the filter 34, and into passages 46 leading to the internal oil distribution passage system of the internal combustion engine 12.

During the purging operation, a pump 24 is energized to draw fluid from the oil reservoir 26 through the drain line 28 of the internal combustion engine and through fluid connection 50 for discharge into the spent oil storage receptacle 16. After the purge air stops, the oil filter element 34 of the internal combustion engine 12 can be removed and replaced with a clean filter element 34 during or after the emptying cycle. After the oil reservoir 26 of the internal combustion engine has been emptied, the evacuation pump stops automatically. Fresh oil can then be introduced into the internal oil lubrication distribution passage system by activating at least one of the fresh oil supply 18 or the reconditioned oil supply 130 to allow flow to the internal combustion engine 12. Means are provided for drawing new (virgin) motor oil from a receptacle 18 and/or from a reconditioned oil storage receptacle 130 for discharge into the internal combustion engine through the oil filter element 34 into the internal oil lubrication distribution passage 46 system for accumulation in the oil pan reservoir 26 of the internal combustion engine 12. It is to be understood that new oil only from receptacle 18 may be introduced into engine 12; or reconditioned oil only from storage receptacle 130 may be introduced into engine 12; or any mixture of the two, as desired. The fresh motor oil supply follows the same path as was done by the compressed air previously mentioned.

When an adequate amount of fresh motor oil has been delivered to the internal combustion engine by the introducing means 30 and as determined by the information provided to the oil exchange apparatus 10, the introducing means 30 stops. The quick connect couplings 44 and 50 are then disconnected from the oil exchange apparatus 10. The internal combustion engine 12 is now ready for normal use with the oil filter element having been precharged with fresh oil to the engine components and oil passages which are prelubricated with fresh or filtered oil prior to starting the engine, thereby providing instant oil pressure. The amount of fresh oil added can be recorded to the vehicle electronic module 14. Other information may also be stored in the vehicle electronic module, such as date, miles since previous oil change and the like.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. In an apparatus connectable to a vehicle for on-site oil changing by removal of spent oil from the vehicle, oil reconditioning, and introduction of the reconditioned oil into an internal combustion engine of the vehicle having an internal oil lubrication system and oil filter and an oil reservoir, the improvement comprising:

means for removing finite particles from the spent oil to produce substantially particle-free oil;

means, in fluid communication with the finite particle removing means, for refining the substantially particle-free oil to remove at least one of water, fuel, and glycols to produce substantially re-refined oil; and means, in fluid communication with the refining means, for adjusting the composition of the substantially re-refined oil to meet a predetermined specification to produce the reconditioned oil.

2. The oil reconditioning apparatus as defined in claim 1 wherein the finite particle removing means comprises at least one of an electrostatic precipitation device, a centrifuge, and a media filtration device.

3. The oil reconditioning apparatus as defined in claim 2 wherein the finite particle removing means comprises an electrostatic precipitation device.

4. The oil reconditioning apparatus as defined in claim 1 wherein the refining means comprises a batch system refining device.

5. The oil reconditioning apparatus as defined in claim 1 wherein the reconditioned oil includes a plurality of desired components, each of the plurality of components having an associated predetermined specification, and wherein the adjusting means comprises:

means for analyzing the re-refined oil to determine the presence and amount of at least one of the plurality of desired components; and means, in fluid communication with the analyzing means, for introducing at least one additive to adjust a corresponding component to meet the associated predetermined specification.

6. The oil reconditioning apparatus as defined in claim 5 wherein the desired components comprise viscosity-index improvers, lubricants, and buffering materials.

7. The oil reconditioning apparatus as defined in claim 5 wherein the introducing means is in fluid communication with a reconditioned oil storage tank.

8. The oil reconditioning apparatus as defined in claim 5 wherein the oil is a synthetic engine oil.

9. The oil reconditioning apparatus as defined in claim 1 wherein the oil reconditioning apparatus is portable.

10. The oil reconditioning apparatus as defined in claim 1 wherein the oil filter has an inlet side and wherein the oil changing apparatus comprises:

means for evacuating fluid from the oil filter into the oil reservoir;

means for removing fluid from the oil reservoir, wherein the fluid removing means includes an oil exit port in fluid communication with the oil reservoir via internal passages and a drain line, the passage and the drain line each being configured and arranged for placement in the internal combustion engine;

means for introducing fluid into the oil reservoir through the oil filter and internal-oil lubrication system, wherein the fluid introducing means includes an oil inlet port in fluid communication with the inlet side of the oil filter;

means for monitoring the position of the oil filter relative to the internal oil lubrication system, wherein the oil filter is in a connect position when the oil filter is securely positioned with respect to the internal oil lubrication system and the oil filter is in a disconnect position when the oil filter is in a position other than securely positioned with respect to the internal oil lubrication system; and means for deactivating the fluid introducing means when the oil filter is in a disconnect position.

11. In a portable apparatus connectable to a vehicle for on-site synthetic oil reconditioning, the apparatus configured and arranged for changing oil by removing spent oil from, and introducing reconditioned oil into an internal combustion diesel engine having an internal lubrication system, an oil filter and an oil reservoir, the improvement comprising:

means for removing finite particles from the spent oil to produce substantially particle-free oil, wherein the finite particle removing means comprises an electrostatic precipitation device;

means, in fluid communication with the finite particle removing means, for refining the substantially particle-free oil to remove at least one of water, fuel, and glycols to produce substantially re-refined oil, wherein the refining means comprises a hydraulic batch system refining device; and means, in fluid communication with the refining means, for adjusting the composition of the substantially re-refined oil to meet a plurality of predetermined specifications, including viscosity, lubricity and pH, to produce the reconditioned oil, wherein the adjusting means comprises:

means for determining the viscosity, lubricity and pH of the substantially re-refined oil; and means for introducing at least one additive to adjust at least one of the viscosity, lubricity and pH to meet the predetermined specification.

12. The oil reconditioning apparatus as defined in claim 11 wherein the internal combustion diesel engine includes an engine block and the oil filter has an inlet side, and wherein the oil changing apparatus comprises:

means for purging fluid from the oil filter into the oil reservoir;

means for removing fluid from the oil reservoir, wherein the fluid removing means includes an oil exit port in fluid communication with the oil reservoir via internal passages and a drain line, the passages and the drain line each being configured and arranged for placement in the internal combustion engine;

means for introducing fluid into the oil reservoir through the oil filter and internal oil lubrication system, wherein the fluid introducing means includes an oil inlet port in fluid communication with the inlet side of the oil filter, wherein the oil inlet port and oil exit port are placed into the engine block proximate the oil filter;

means for monitoring the position of the oil filter relative to the internal oil lubrication system, wherein the oil filter is in a connect position when the oil filter is securely positioned on the internal oil lubrication system and the oil filter is in a disconnect position when the oil filter is in a position other than securely positioned on the internal oil lubrication system; and means for deactivating the fluid introducing means when the oil filter is in a disconnect position.

13. The oil reconditioning apparatus as defined in claim 12, wherein the drain line is directly connected from the oil exit port to the oil reservoir.

14. The oil reconditioning apparatus as defined in claim 13, wherein valve means are disposed in the drain line between the oil exit port and the oil reservoir.

15. A process for reconditioning oil for an internal combustion engine on a vehicle on-site at a user's facility, the process comprising the steps of:

stopping the internal combustion engine on the vehicle;

removing spent oil from the internal combustion engine having an internal oil lubrication system, an oil filter and an oil reservoir;

removing finite particles from the spent oil to produce substantially particle-free oil;

refining the substantially particle-free oil to remove at least one of water, fuel, and glycols to produce substantially re-refined oil;

adjusting the composition of the substantially re-refined oil to meet a predetermined specification to produce reconditioned oil; and introducing the reconditioned oil into the internal combustion engine.

16. The process as defined in claim 15, further comprising the step of storing the reconditioned oil before introducing the reconditioned oil into the engine.

17. The process as defined in claim 15 wherein the internal combustion engine has an engine block and the oil filter has an inlet side, and wherein the removing spent oil and introducing reconditioned oil steps are performed by an oil changing apparatus, comprising:

means for evacuating fluid from the oil filter into the oil reservoir;

means for removing fluid from the oil reservoir, wherein the fluid removing means includes an oil exit port in fluid communication with the oil reservoir via internal passages and a drain line, the passages and the drain line each being configured and arranged for placement in the internal combustion engine;

means for introducing fluid into the oil reservoir through the oil filter and internal oil lubrication system, wherein the fluid introducing means includes an oil inlet port in fluid communication with the inlet side of the oil filter, and wherein the oil inlet port and oil exit port are defined in the engine block proximate the oil filter;

means for monitoring the position of the oil filter relative to the internal oil lubrication system, wherein the oil filter is in a connect position when the oil filter is securely positioned with respect to the internal oil lubrication system and the oil filter is in a disconnect position when the oil filter is in a position other than securely positioned with respect to the internal oil lubrication system; and means for deactivating the fluid introducing means when the oil filter is in a disconnect position;

means for monitoring an engine running condition of the internal combustion engine, wherein the monitoring means for an internal combustion engine running condition comprises a signal generated by an oil pressure sensor; and means for deactivating the fluid removing means when the internal combustion engine is in the engine running condition, wherein the apparatus is connected to an electronic module in communication with the internal combustion engine.

18. The process as defined in claim 17, wherein the internal combustion engine is fitted with an electronic microchip which carries oil change information, and wherein the process further comprises the step of recording oil change data.

19. The process as defined in claim 15 wherein the oil is synthetic engine oil.

20. The process as defined in claim 15 wherein the internal combustion engine is a diesel engine.

* * * * *